US005947522A

United States Patent [19]

Boehm

[11] Patent Number: 5,947,522

[45] Date of Patent: Sep. 7, 1999

[54] THEMATIC BOUND SCRAPBOOK

[76] Inventor: Janis Boehm, 60 S. Dee RP., Park Ridge, Ill. 60068

[21] Appl. No.: 09/049,621

[22] Filed: Mar. 27, 1998

[51] Int. Cl.[6] ..... B42D 1/08

[52] U.S. Cl. ..... 281/22; 281/38; 281/16; 402/79

[58] Field of Search ..... 281/15.1, 16, 17, 281/22, 29, 38, 31; 402/4, 79, 80 R; 283/63.1

[56] References Cited

U.S. PATENT DOCUMENTS

| | | | |
|---|---|---|---|
| 2,193,545 | 3/1940 | Ainsworth | 281/22 X |
| 2,516,045 | 7/1950 | Bryan et al. | 281/22 X |
| 3,344,794 | 10/1967 | MacWilliams | 281/22 X |
| 4,419,837 | 12/1983 | Meeker | 40/359 |
| 4,451,067 | 5/1984 | Williams | 281/31 |
| 4,824,273 | 4/1989 | Silva et al. | 402/79 |
| 4,934,739 | 6/1990 | Stancato | 281/38 |
| 4,965,948 | 10/1990 | Ruebens | 40/537 |
| 4,971,361 | 11/1990 | Whiting | 281/2 |
| 5,015,011 | 5/1991 | York | 281/18 |
| 5,031,935 | 7/1991 | D'Andrea | 281/15.1 |
| 5,284,361 | 2/1994 | Walker et al. | 281/15.1 |
| 5,316,341 | 5/1994 | Schwartz | 281/15.1 |
| 5,380,043 | 1/1995 | Schwartz | 281/15.1 |
| 5,417,509 | 5/1995 | Schwartz | 402/79 |
| 5,816,730 | 10/1998 | Alspaw et al. | 281/22 X |

*Primary Examiner*—Willmon Fridie, Jr.
*Attorney, Agent, or Firm*—Brinks Hofer Gilson & Lione

[57] ABSTRACT

A theme-based scrapbook includes a plurality of folders bound between a front cover and a back cover. Each of the plurality of folders includes a folder cover comprised of an inner portion and an outer portion. An inner edge of the inner portion of each folder cover is bound to the other folders and the front and back covers. The outer portion of the folder cover folds over the inner portion to form the interior of the folder. Located in the interior of each folder are a plurality of display sheets. Also located in the interior of each folder is a pocket. The pocket is affixed to the inner portion of the folder cover in the interior of the folder. Each scrapbook includes lettering or indicia indicating a specific theme. Each of the plurality of folders may include indicia that indicates a logical sub-categorization of the theme. The plurality of folders and their structure facilitate the collection and organization of memorabilia related to the specified theme.

19 Claims, 11 Drawing Sheets

THEMATIC BOUND SCRAPBOOK

BACKGROUND OF THE INVENTION

The present invention relates to scrapbooks and in particular the present invention relates to an improved scrapbook that can be used to store various memorabilia associated with selected themes.

Various scrapbooks have been developed over the years to allow persons to store collectable items. For example, various scrapbooks may include pages upon which photographs can be attached. Other scrapbooks may provide other features, such as pockets for storing items that the person may wish to later take out and examine.

Many prior scrapbooks provide for storing one kind of memorabilia but not another. Thus, a person using some prior scrapbooks has to use various different means to store memorabilia that he or she may wish to save. When a person has to use different ways to store memorabilia, there is an increased possibility that some items may become lost or misplaced. Another disadvantage associated with prior scrapbooks is that a person using a prior scrapbook may overlook saving some important kind of memorabilia. Still another disadvantage associated with prior scrapbooks is that they fail to organize the memorabilia stored therein. Thus, although many kinds of scrapbooks have been developed over the years, there still exists a need for improvement.

Accordingly, it is an objective to provide an improved scrapbook that facilitates saving different kinds of items. It is another objective to provide an improved scrapbook that organizes the saving of items so that the saving of important items is not overlooked. It is still another objective to provide an improved scrapbook that facilitates the savings of various items based upon themes.

SUMMARY OF THE INVENTION

To address the above concerns, according to one aspect of the present invention, there is provided a theme-based scrapbook. The theme-based scrapbook includes a plurality of folders bound between a front cover and a back cover. Each of the plurality of folders includes a folder cover comprised of an inner portion and an outer portion. An inner edge of the inner portion of each folder cover is bound to the other folders and the front and back covers. The outer portion of the folder cover folds over the inner portion to form a front of the folder with an interior of the folder formed between the inner portion and the folded over outer portion. Located in the interior of each folder are a plurality of display sheets. Also located in the interior of each folder is a pocket. The pocket is affixed to the inner portion of the folder cover in the interior of the folder. Each scrapbook includes lettering or indicia that identifies or focuses on a specific theme. Each of the plurality of folders may include indicia that indicates a logical sub-categorization of the theme. The plurality of folders and their structure facilitate the collection and organization of memorabilia related to the specified theme.

DETAILED DESCRIPTION OF THE PRESENTLY PREFERRED EMBODIMENTS

Figure 1:
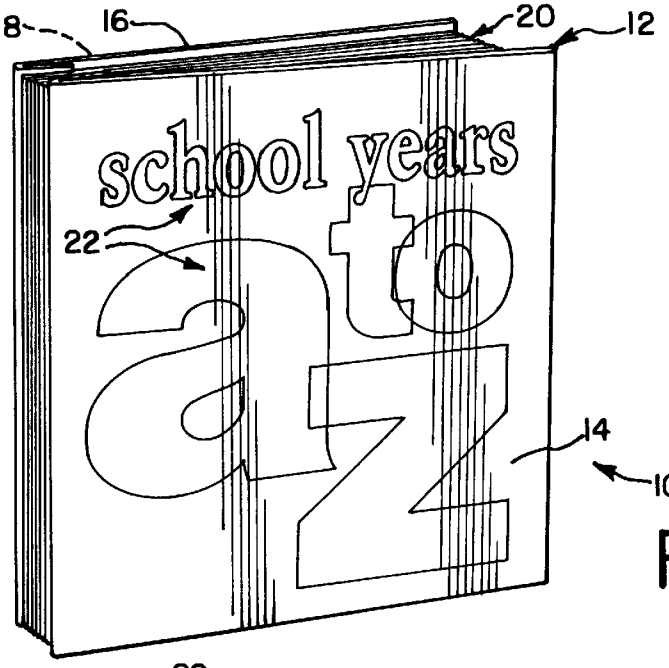
FIG. 1 is a perspective view of a scrapbook according to one embodiment of the present invention.

FIGS. 1–7 show a scrapbook 10 according to a first embodiment of the present invention. Referring to FIG. 1, the scrapbook 10 has a front cover 12 having a front side 14 and a rear cover 16 having a rear side 18. Bound between the front cover 12 and the rear cover 16 are the internal components 20 of the scrapbook 10.

Located on the front side 14 of the front cover 12 of the scrapbook 10 is lettering or other indicia 22. The lettering or indicia 22 communicate a theme associated with the scrapbook 10. According to this embodiment, each scrapbook 10 is associated with a theme. The scrapbook in FIG. I has a "school years" theme, specifically "School years A to Z." The theme of this scrapbook 10 is intended to be all-inclusive relative to school years.

Figure 2:
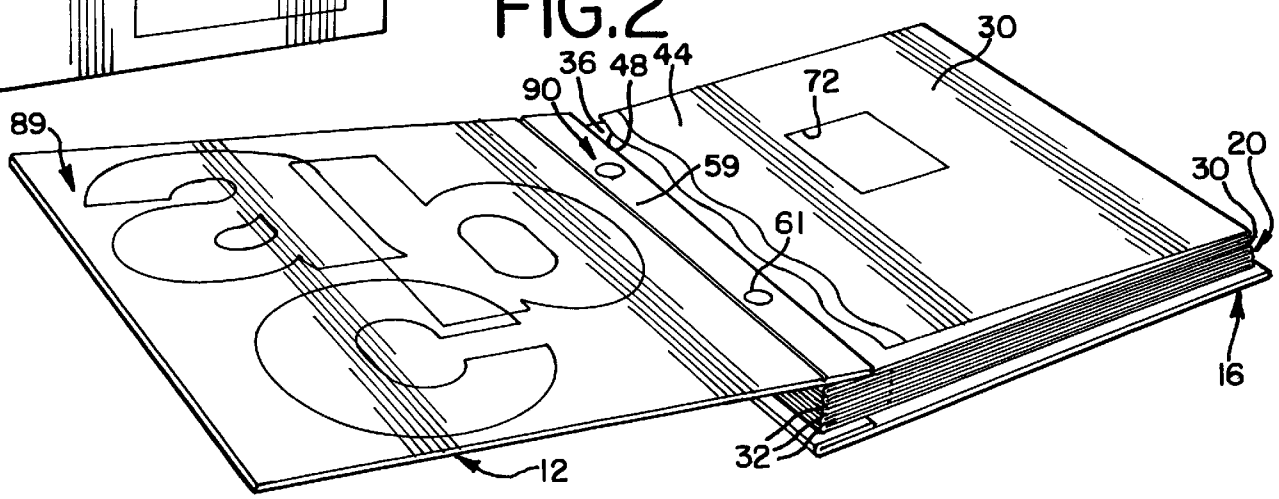
FIG. 2 is a perspective view of the scrapbook of FIG. 1 shown in an open configuration.
Figure 3:
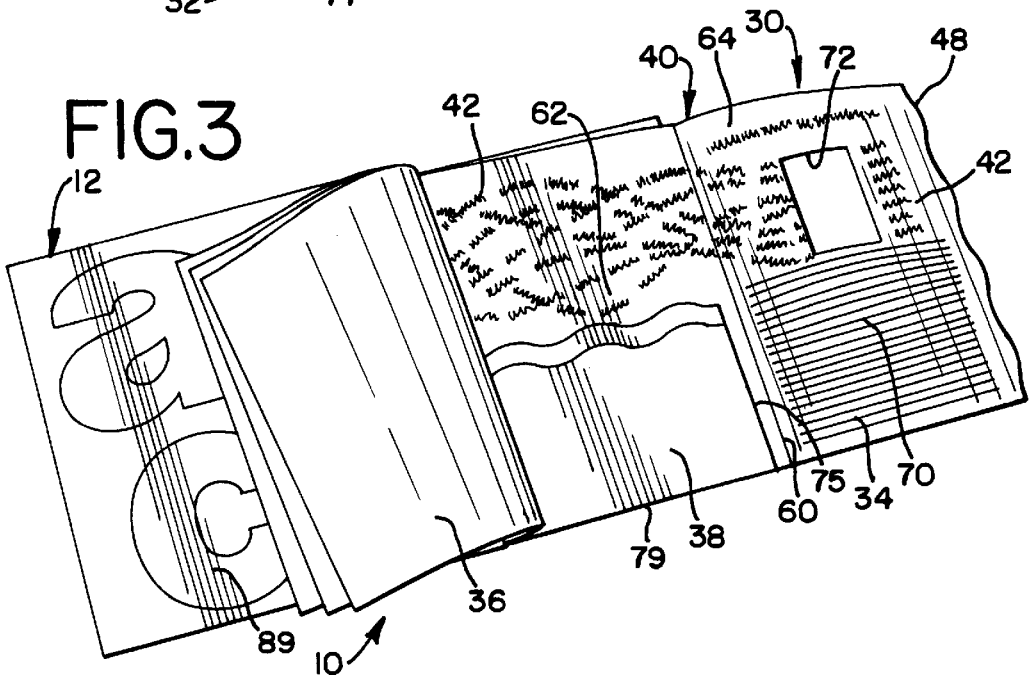
FIG. 3 is another perspective view of the scrapbook of FIG. 1 shown in an open configuration with one of the folders also shown in an open configuration.

FIGS. 2 and 3 show perspective views of the "school years" theme scrapbook 10 of FIG. 1. In FIGS. 2 and 3, the scrapbook 10 is opened to reveal a plurality of folders 30. In a present embodiment, there are ten folders, although in alternative embodiments, there may be more or fewer folders.

FIG. 3 shows one of the folders 30 opened to reveal its component parts. As shown in FIG. 3, each folder 30 consists of a folder cover 34, a plurality of display sheets 36, and a pocket 38. Each of the other folders 30 may include similar component parts including a similar folder cover, display sheets, and pocket.

As shown in FIG. 3, the folder cover 34 of the folder 30 is formed of a double-sized sheet 40. The sheet 40 may be formed of cardboard, heavy weight paper, plastic, or other durable material. The sheet 40 has a first side 42 and a second side 44 (not shown in FIG. 3) opposite the first side 42.

Figure 4:
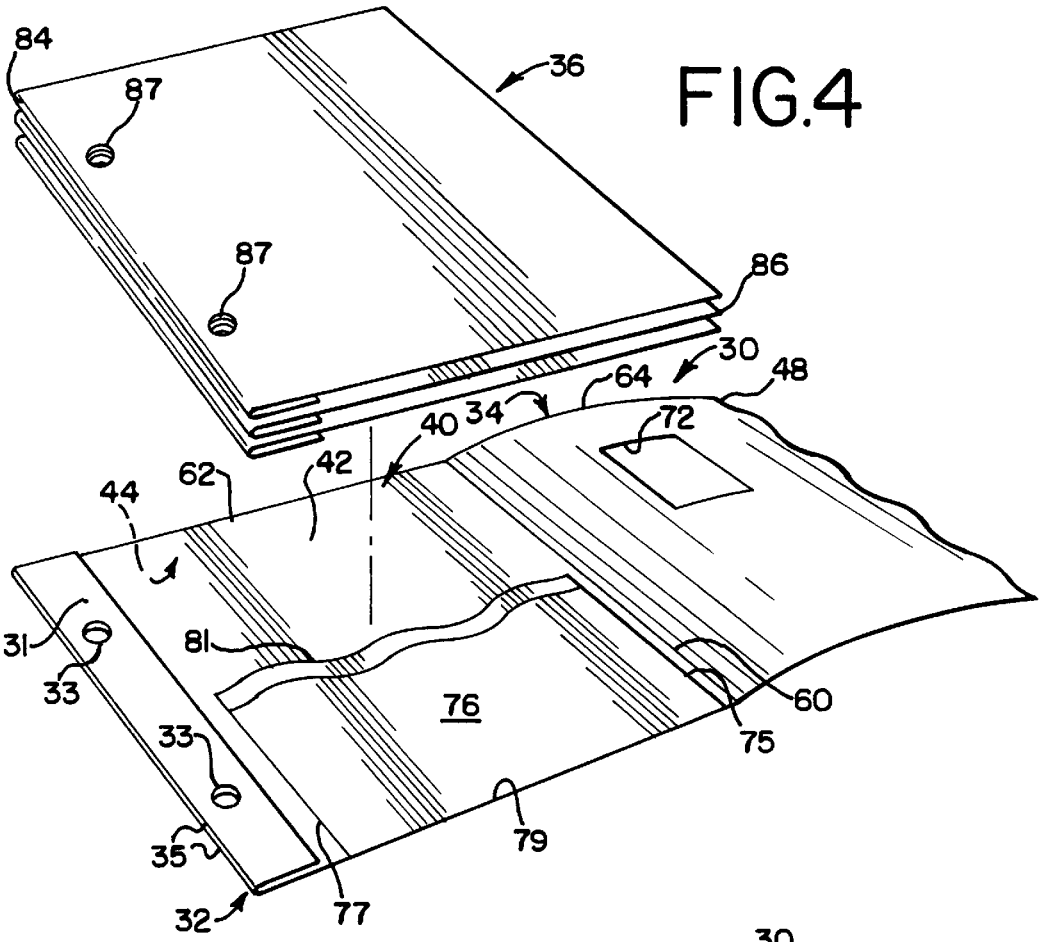
FIG. 4 is a perspective view of one of the folders in FIG. 3 shown in an open configuration with the display sheets removed.

Referring to FIGS. 3 and 4, each of the folder covers 34 has an inside edge 46 and an outside edge 48 opposite from the inside edge 46. The inside edge 46 of the folder cover 34 forms the inside edge of the folder 30 of which it is a component part.

Between the inside edge 46 and the outside edge 48, the sheet 40 which forms the folder cover 34 has a centerfold 60.

The centerfold 60 divides the folder cover 34 into an inner half portion 62 and an outer half portion 64. The centerfold 60 enables the outer half portion 62 of the folder cover 34 to form a flap which can fold forward over the inner half portion 62. When the outer half portion 64 is folded over the inner half portion 62, the first side 42 of the sheet 40 from which the folder cover 34 is formed forms the inside surface of the folder cover 34 and the second side 44 of the sheet 40 from which the folder cover 34 is formed forms the outside surface of the folder cover 34. When the outer half portion 64 is folded forward over the inner half portion 62, the outer surface of the folder cover 34 at the location of the centerfold 60 now forms an outer edge of the cover 30 opposite the inner edge 46 of the folder cover 34. The outer half portion 64 of the folder cover 34 (from the centerfold 60 to the outside edge 48) is slightly narrower than the inner half portion 62 (from the inside edge 46 to the centerfold 60). For example, if the inner half portion 62 is approximately 11 inches, the outer half portion 64 may be approximately 9¾ inches. This enables the outer half portion 64 to be easily folded over the inner half portion 62 with the edge 48 close to, but not quite reaching, the binding area along the inside edge 46. In a preferred embodiment the outer edge 48 has a decorative cut shape.

Referring to FIG. 4, in one present embodiment, the inside edge 46 of the folder cover 34 is formed of two 90° folds 35 of the sheet 40 from which the folder cover 34 is made. These two 90° folds 35 are approximately ⅛ inch apart. The sheet extends approximately 1 inch beyond the two folds 35 that form the inside edge 46 of the cover folder 34 in order to form an inside flap 31 that folds over the inner half portion 62 of the folder cover sheet 34. Because the 90° folds 35 are approximately ⅛ inch apart, the flap 31 is spaced approximately ⅛ inch from the inner half portion 62 thereby allowing room in the folder cover 34 for the display sheets 36.

Figure 6:
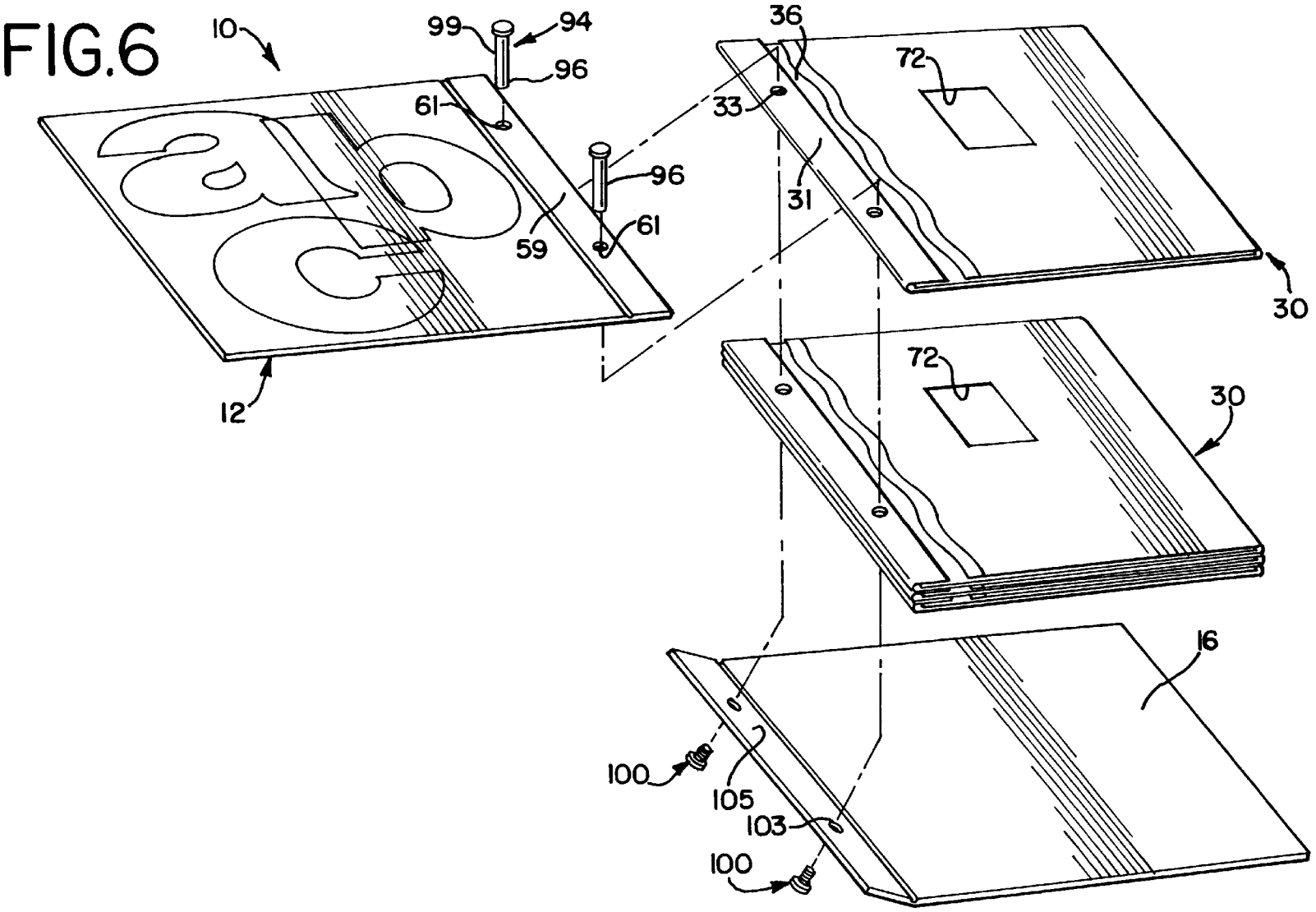
FIG. 6 is a perspective view of the scrapbook of FIG. 1 shown partially disassembled.

Referring to FIGS. 2 and 6, each of the folders 30 is bound along its inside edge 32 to the front and back covers 12 and 16. The front cover 12 includes a flap 59 located along its inside edge. Extending through the front cover flap 59 are a plurality of drilled holes or openings 61. A similar plurality of drilled holes 103 extend through a corresponding flap 105 located along an inside edge of the back cover 16, as shown in FIG. 6.

Referring to FIG. 4, the inside edge 46 of each folder cover 34 includes a plurality of die cut holes 33. The die cut holes 33 extend through the flap 31 and the portion of the inner half portion 62 along the inside edge 46. The die cut holes 33 in each folder cover 34 form part of the means by which the folder 30 is attached to the front cover 12 and back cover 16. Fasteners, such as aluminum screw posts 90 shown in FIG. 6, extend through the drilled holes 61 in the flap 59 of the front cover 12, the die cut holes 33 in the folders 30, and the drilled holes 103 in the flap 105 of the back cover 16 to bind the plurality of folders 30 between the front cover 12 and back cover 16, as explained further below.

Referring to FIG. 3, included on the inside surface of each folder cover 34 is a legend area 70. The legend area 70 is preferably located on the first side 42 of the sheet 40 which corresponds to the inside surface of the outer half portion 64. The legend area 70 is formed in an area of the inside surface upon which writing is permitted. A plurality of horizontal spaced lines may be provided in the legend area 70 to facilitate writing.

Referring to FIGS. 3 and 4, the pocket 38 is located on the inside surface of the folder cover 34. Specifically, the pocket 38 is located along the inner half portion 62. The pocket 38 is located on a lower part of the inside surface of the inner half portion 62. The pocket 38 extends approximately half the height of the sheet 40 (i.e., halfway from the bottom edge to the top edge). The outer side edge 75 of the pocket 38 is not affixed to the inside surface of the inner half portion 62. The inner side edge 77 of the pocket 38 is sealed to the inside surface of the inner half portion 62. The bottom edge 79 of the pocket 38 is closed or otherwise sealed. The pocket 38 may be formed of a single piece of material with the sheet 40 that forms the folder cover 34, and accordingly, the bottom edge 79 of the pocket 38 may be formed by an upward fold of such a single piece of material. Alternatively, the bottom edge 79 of the pocket 38 may be glued or otherwise sealed to the sheet of material 40 that forms the inner half portion 62. A top edge 81 of the pocket 38 is open so that loose items can be stored in the pocket 38. In a preferred embodiment, the top edge 81 of the pocket 38 has a decorative cut shape. In one embodiment, the decorative cut shape is similar to the decorative shape of the edge 48 of the outer half portion 64 of the folder cover 34. In one embodiment, the shape is wavy.

Referring to FIG. 4, as mentioned above, each folder 30 includes a plurality of display sheets 36. Each of the display sheets 36 has an inside edge 84 and an outside edge 86. The inside edge 84 of each display sheet 36 may include a plurality of drilled holes or openings 87 through which the screw posts or other fastening means may be used to bind the display sheets 36 inside the folder cover 34 and between the front and back covers 12 and 16. In a preferred embodiment, the plurality of display sheets 36 are located directly in front of the inner half portion 62 of the folder cover 34 so that when the outer half portion 64 is folded over, the plurality of display sheets 36 are encompassed inside the folder cover 34 between the inner half portion 62 and the outer half portion 64. In a preferred embodiment, each display sheet 36 has a width slightly less than that of the inner half portion 62 so that the outer half portion 64 can easily fold over the plurality of display sheets 36. The display sheets 36 are suitable for mounting photos, articles, and other memorabilia. Accordingly, the display sheets 36 may be blank, or alternatively the display sheets 36 may include decorative graphics associated with the theme.

Located in an upper part of the outer half portion 64 is an opening or cutout 72. The opening 72 is located in the upper part of the outer half portion 64. The opening 72 is located so that a photograph or other item which is affixed onto a side of the topmost display sheet 36 in the folder 30 is visible through the opening 72 when the outer half portion 64 is closed over the inner half portion 62.

Figure 5A:
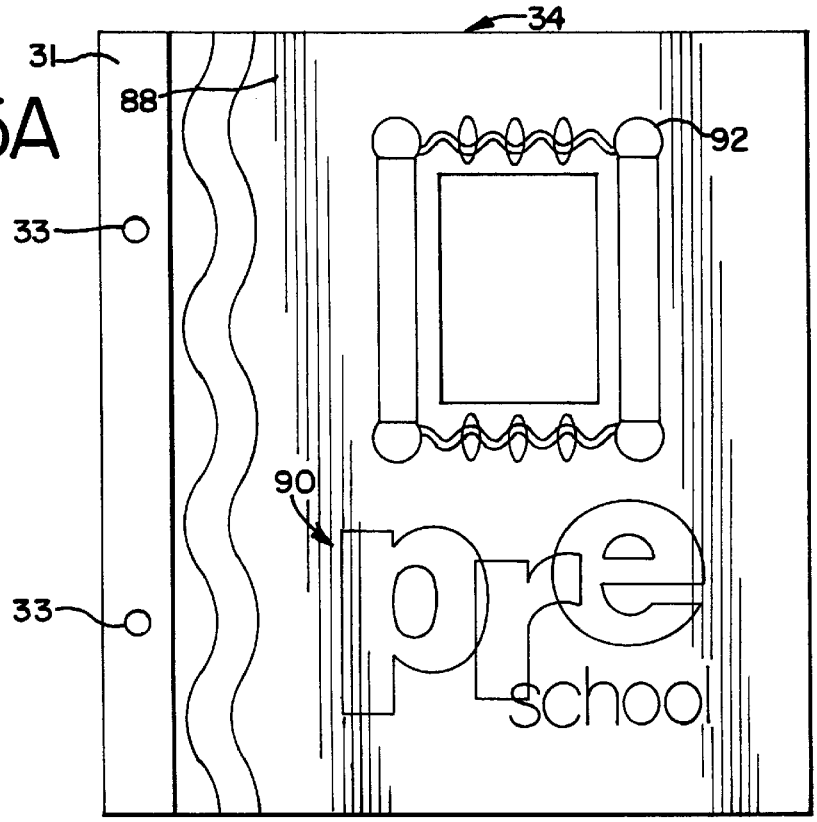
FIGS. 5A through 5J each show a front view of a separate one of the folder covers in the embodiment of the scrapbook shown in FIG. 1.

As shown in FIGS. 2 and 5A, when the outer half portion 64 of the folder cover 34 is folded over the inner half portion 62, the side 44 of the sheet 40 from which the folder cover 34 is made forms an outer surface 88 of the folder cover 34. Located on the outer surface 88 of the folder cover 34 is lettering or other indicia 90. This lettering or indicia 90 indicates a sub-division or categorization of the theme of the scrapbook 10. For example, as shown in FIG. 5A, the lettering 90 on the folder cover 34 indicates "pre-school."

As mentioned above, the scrapbook 10 includes a plurality of folder 30. In a preferred embodiment, the "school years" theme scrapbook has a folder 30 for each year of school from pre-school through eighth grade. Each of the other folder covers 34 associated with the other nine folders 30 includes different lettering or indicia 90 that indicate a respective sub-division or sub-category of the "school years" theme.

Figure 5B:
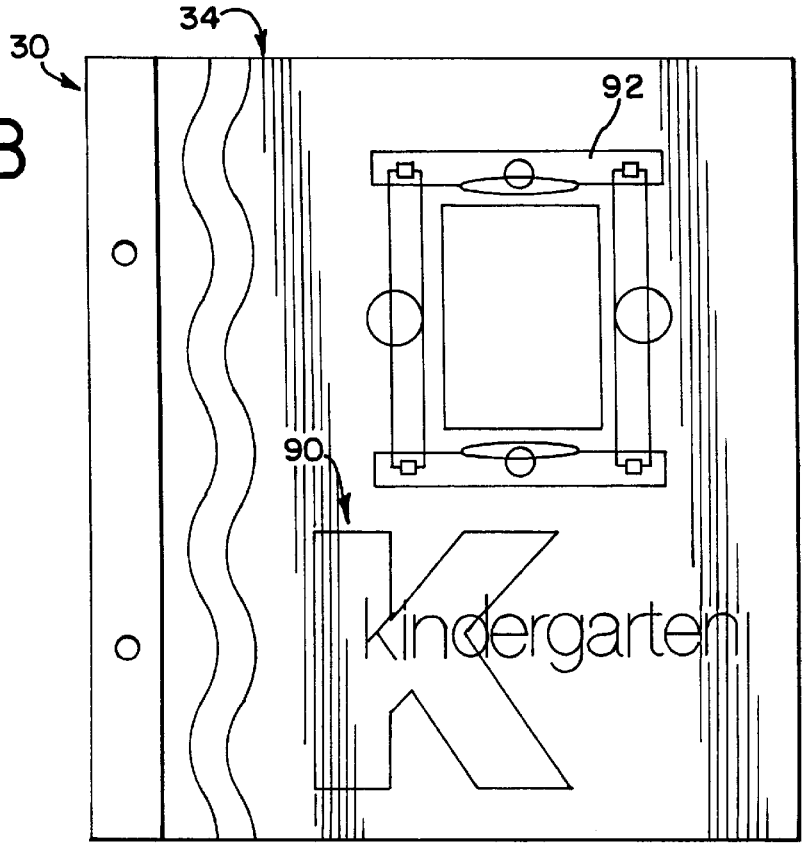
Figure 5C:
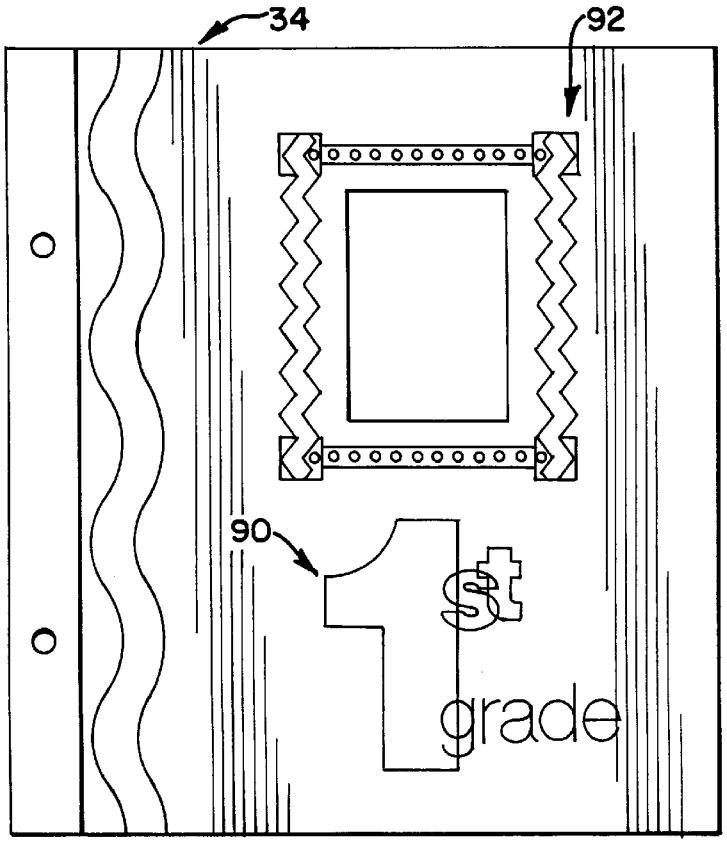
Figure 5D:
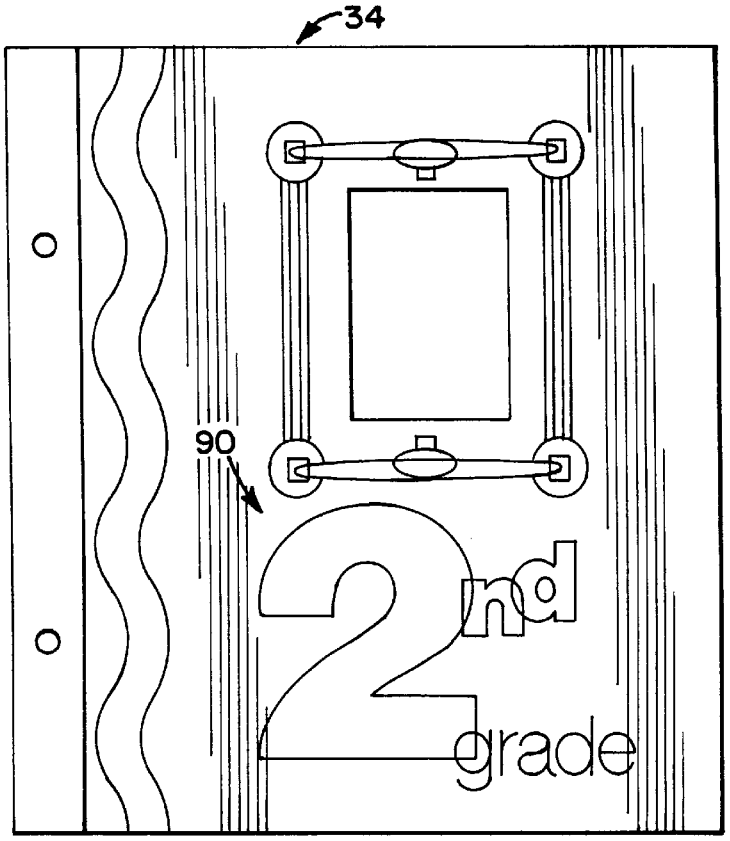
Figure 5E:
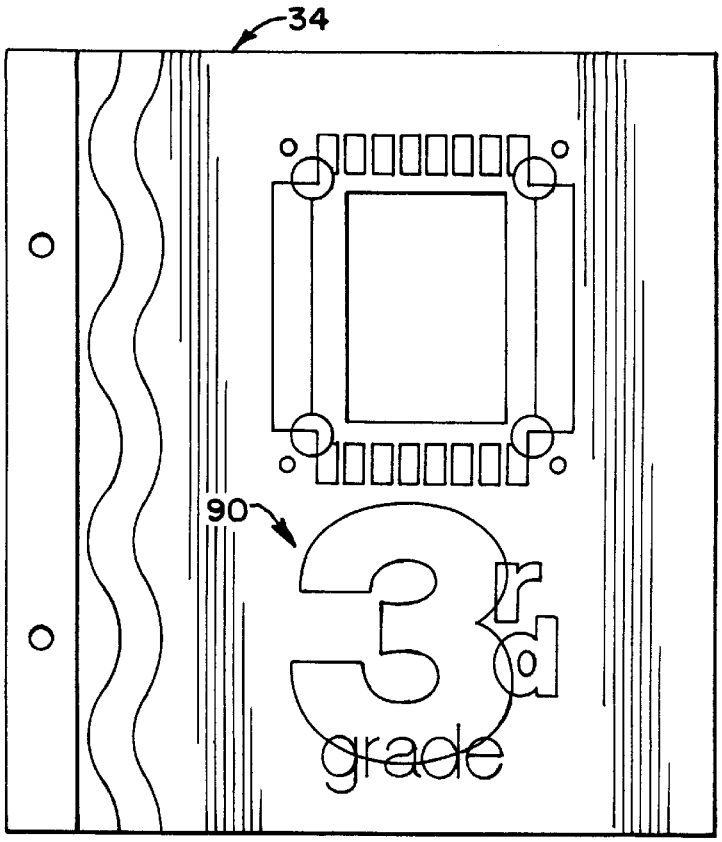
Figure 5F:
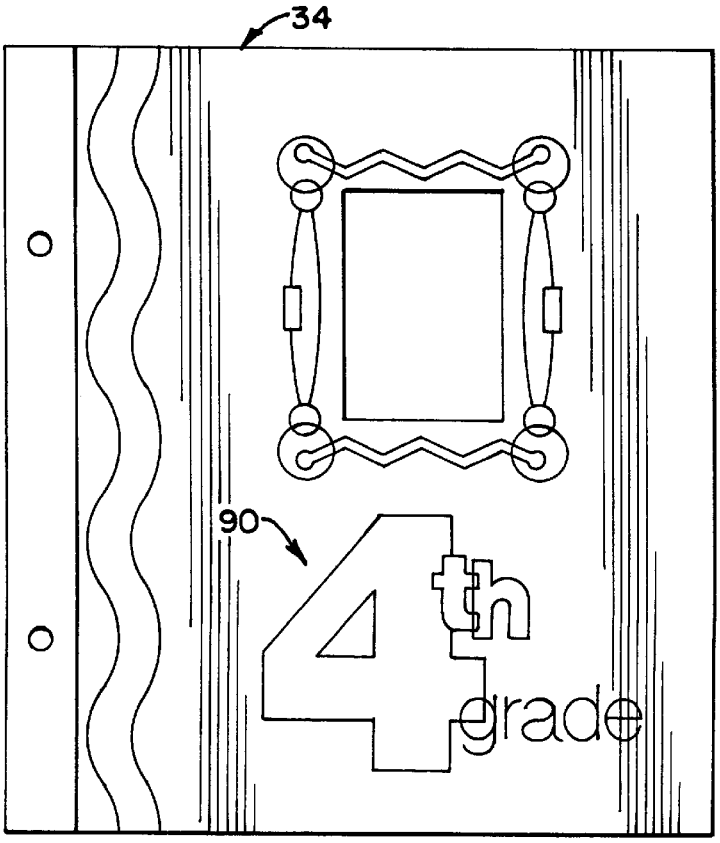
Figure 5G:
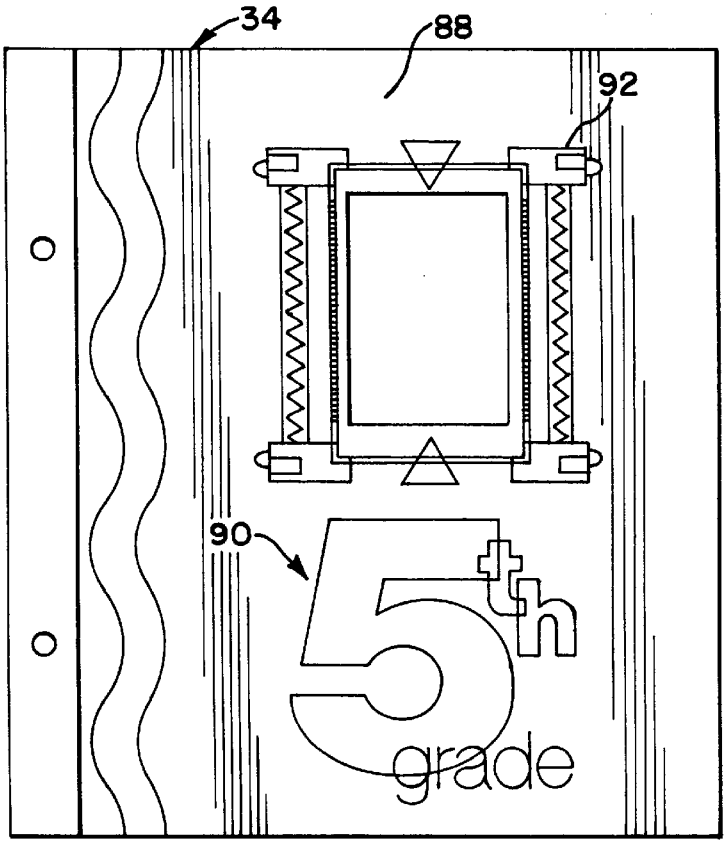
Figure 5H:
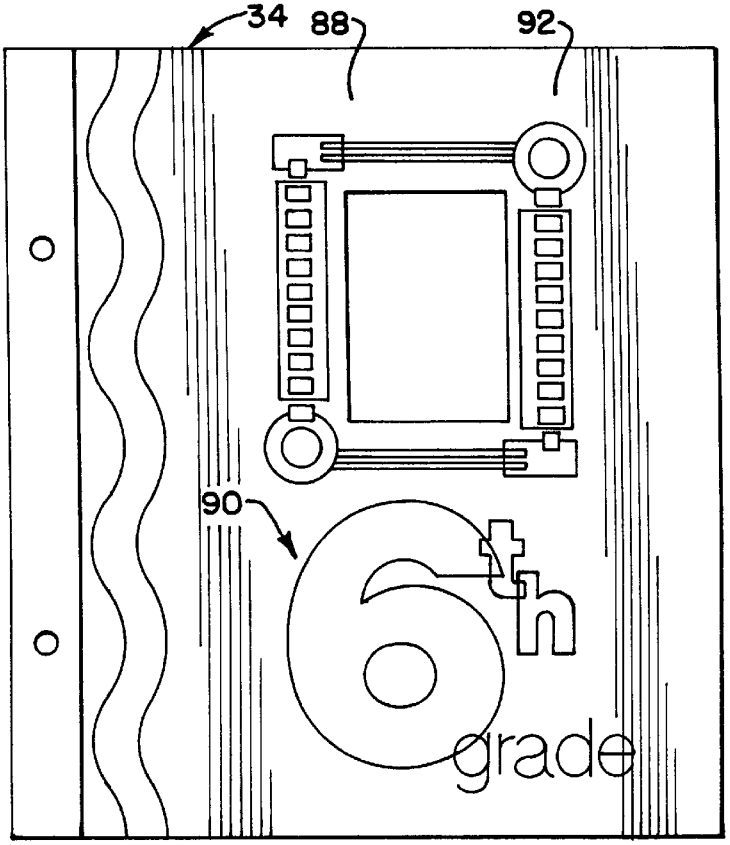
Figure 5I:
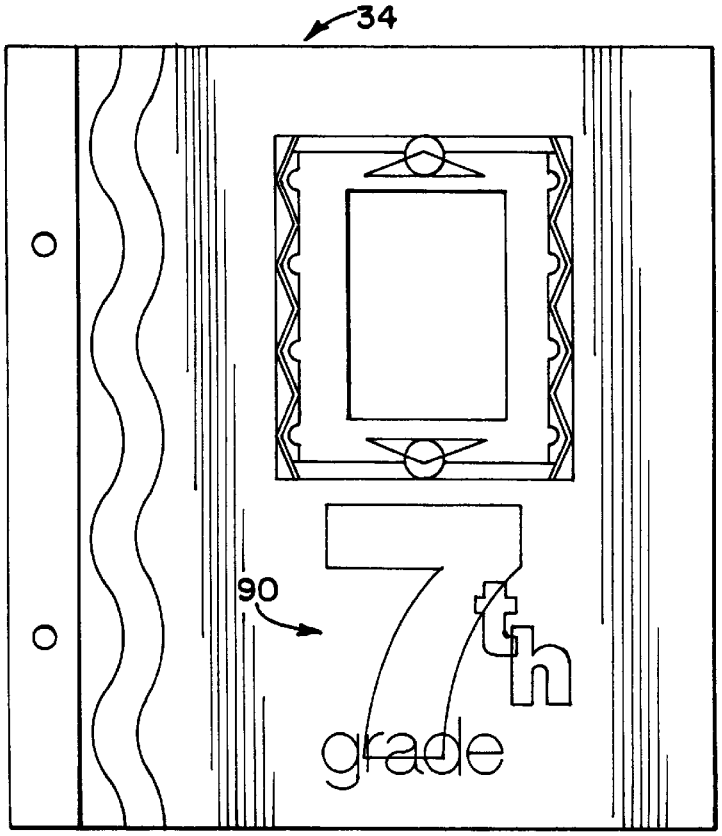
Figure 5J:
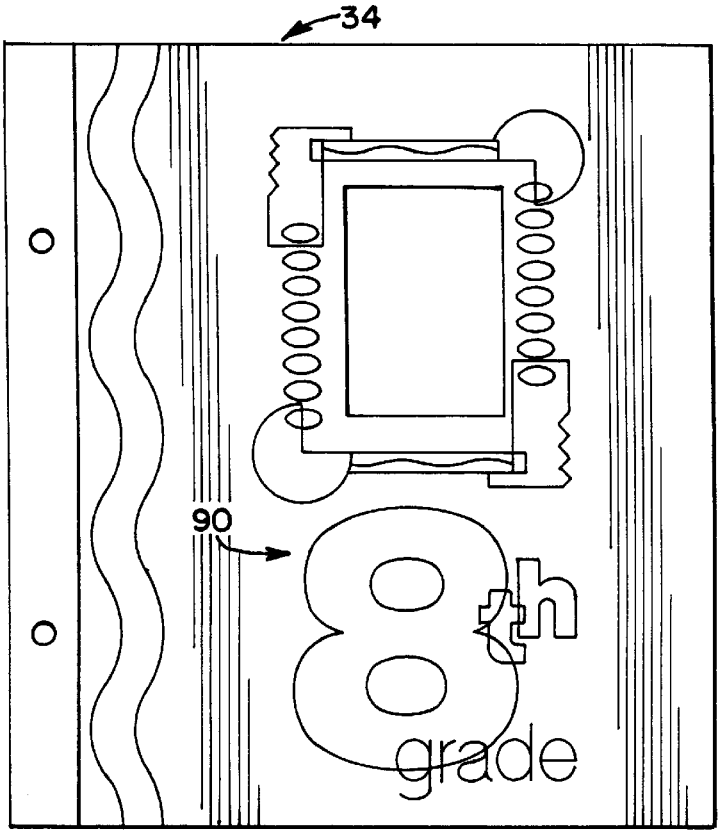

FIGS. 5B through 5J show the other folder covers 30 associated with each of the other nine folders 30. Each of these folder covers 34 includes appropriate lettering or indicia 90 that indicates its respective sub-division or sub-category of the theme of the scrapbook 10. In FIG. 5B, the lettering 90 indicates "kindergarten." In FIG. 5C, the lettering 90 indicates "first grade." In FIG. 5D, the lettering 90 indicates "second grade." In FIG. 5E, the lettering 90 indicates "third grade." In FIG. 5F, the lettering 90 indicates "fourth grade." In FIG. 5G, the lettering 90 indicates "fifth grade." In FIG. 5H, the lettering 90 indicates "sixth grade." In FIG. 5I, the lettering 90 indicates "seventh grade." In FIG. 5J, the lettering 90 indicates "eighth grade."

Each of these folder covers 34 may also include appropriate graphics 92 on the outer surface 88. The graphics 92 may differentiate the sub-categories associated with each of the different folders 30, but also preferably maintain consistency with the overall theme.

The inside surfaces of the front and back covers 12 and 16 may also include appropriate graphics 89, as shown in FIGS. 2 and 3. These graphics 89 also are preferably consistent with the overall theme.

Referring to FIG. 6, the component parts of the scrapbook 10 can be readily disassembled and rearranged. In FIG. 6, the scrapbook 10 is shown in a stage of disassembly. In a present embodiment, a fastening means 94 is provided to releasibly bind the folders 30 inside the front and back covers 12 and 16. In the present embodiment, the fastening means 94 include a plurality of aluminum screw posts 96. Each of the aluminum screw posts 96 is formed of two parts: a post portion 99 having a threaded internal bore (not shown) and a fastening bolt portion 100 which can be threaded into the bore of the post portion 99. Conventional aluminum screw posts 96 may be used. In one embodiment, each aluminum screw post 96 is approximately 1⅝ inches long and has a shaft of approximately 3/16 inches in outer diameter. The heads on either end of each aluminum screw post 96 may be approximately ⅜ inches in diameter. The aluminum screw posts 96 extend through the holes 61 in the front cover 12, the holes 33 in each of the folder covers 34, the holes 87 in the display sheet covers 36, and the holes 103 in back cover 16 in order to bind them all together. In an alternative embodiment, other kinds of fasteners may be used, such as clamps, ribbons, springs, etc.

To assemble the scrapbook 10, the display sheets 36 are positioned in their corresponding folder covers 34. The post portions 99 of each of the screw posts 96 are inserted through the drilled holes 61 in the flap of one of the front and back covers, 12 and 16. The assembled covers 30, each with its respective display sheets 36 assembled therein, are mounted through their openings 33 onto the post portions 99 of the screw posts 96. After all the folders 30 are mounted on the post portions 99 of the screw posts 96, the other outer cover (12 or 16) is mounted on the post portion 99 of the screw post 96 through the openings in its flap. The bolt portions 100 of the screw posts 96 are threaded into the post portions 99 of the screw posts 96.

In a present embodiment, the front and back covers are formed of 3 mm thick binder board. A plastic laminated surface is turncased upon both the front and back sides of the front and back covers. Each front or back cover is approximately 12½ inches high by 11½ inches in width. The folder covers, when folded, are approximately 12 inches high by 11 inches in width. The folder covers are made of 80 pound cover stock which is laminated with plastic on one side (i.e., side 44 corresponding to the outside), but not on the other side (i.e., side 42 corresponding to the inside). The display sheets are each approximately 12 inches high by 10¾ inches wide. The front and back covers, the cover sheets, and the display sheets are composed of acid free paper. The cutout opening 72 in each folder cover has a size of approximately 2½ inches by 3½ inches. The opening 72 is centered on the outer half portion 64 of the folder cover 34 and located about 2¼ inches from the top edge. The openings 61, 33, 87, and 103 may be ¼ inch in diameter.

Advantages of the disclosed embodiment. The present embodiment provides significant advantages over prior scrapbooks. By identifying the scrapbook with a theme, the scrapbook serves as an important reminder to the user to store memorabilia as it is accumulated. In addition, by providing a theme in an organized manner, the scrapbook 10 also serves the important function of assisting persons to select good examples of memorabilia to include in the scrapbook. Many people accumulate many photographs and therefore it is easy to misplace the best or the favorites. By providing a scrapbook centered around a theme, a person can select the best or favorite items of memorabilia from the large amount of items that may have been collected.

Another important function served by the scrapbook is that it serves to provide for the logical sub-categorization of a theme. For example, by sub-categorizing the "school years" theme, the person is prompted to identify and store items of memorabilia on a regular basis so that items representative of the various stages and ages are saved.

The scrapbook also makes a meaningful gift item. For example, grandparents may give an empty scrapbook for each grandchild.

Figure 7:
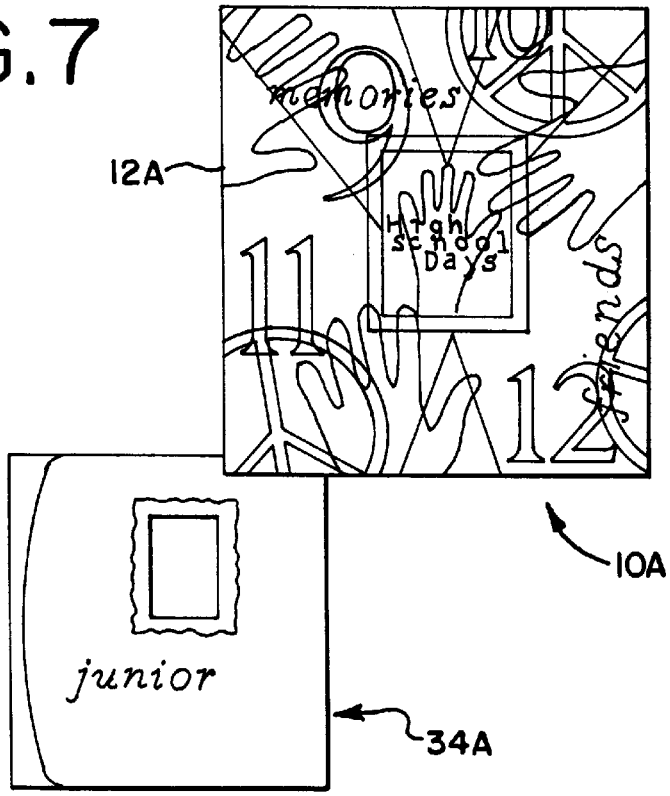
FIG. 7 shows a front view of a front cover and a front view of a folder of a "high school years" theme scrapbook.

Alternative embodiments. Other versions of the scrapbook 10 can be provided that are centered around other themes. Some of these other themes are illustrated in FIGS. 7–13. In FIG. 7, the front cover and a folder cover of a "high school years" theme scrapbook 10A is illustrated. The "high school years" theme scrapbook 10A may be similar to the "school years" theme scrapbook 10, previously described. The graphics and coloring of the "high school years" scrapbook 10A may be different from that of the "school years" theme scrapbook 10. However, like the "school years" theme scrapbook, the "high school years" theme scrapbook 10A would include a plurality of folders, each formed of an inner portion and an outer portion that folds over the inner portion. Like the "school years" theme scrapbook 10, each of the folders in the "high school years" scrapbook 10A includes a plurality of display sheets and a pocket for holding loose items. The "high school years" theme scrapbook 10A may include more or fewer folders than the "school years" scrapbook 10. For example, in one embodiment, the "high school years" theme scrapbook 10A includes separate folders for "freshman," "sophomore," "junior," and "senior." Other folders may be provided.

Figure 8:
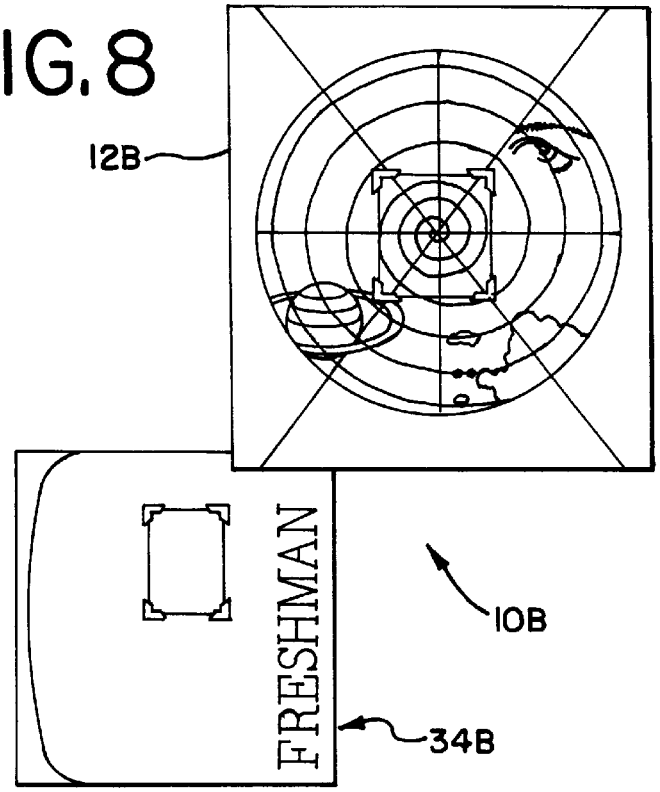
FIG. 8 shows a front view of a front cover and a front view of a folder of a "college years" theme scrapbook.

FIG. 8 shows another theme scrapbook. In FIG. 8. there is shown the front cover and a folder cover of a "college years" theme scrapbook 10B. This "college years" theme scrapbook 10B may have a similar construction as the scrapbooks previously described, except that the graphics and coloring may be different. The college years" scrapbook 10B may have fewer or more folders. In one embodiment, the "college years" scrapbook 10B includes separate folders for "freshman," 33 "sophomore," "junior," and "senior." Other folders may be provided.

Figure 9:
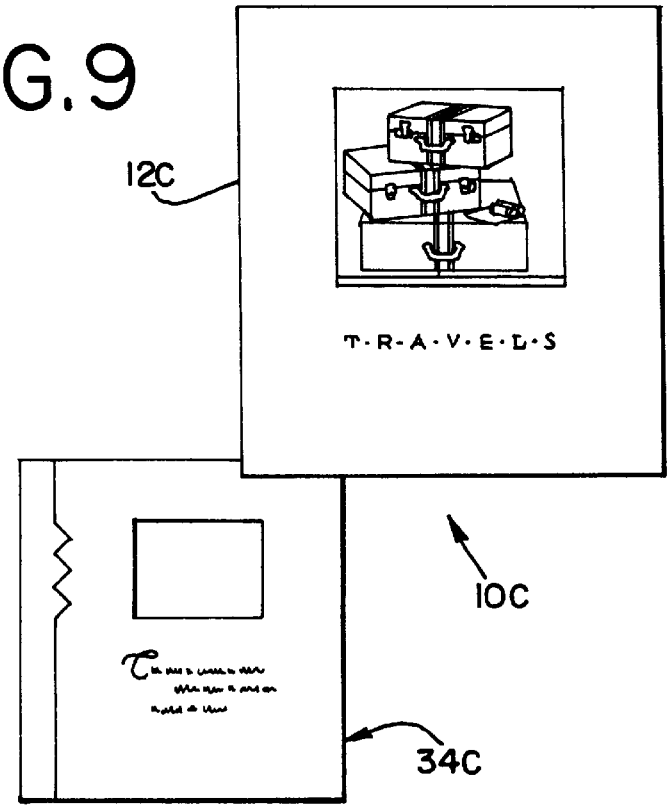
FIG. 9 shows a front view of a front cover and a front view of a folder of a "travel" theme scrapbook.

FIG. 9 shows the front cover and a folder cover of a "travel" theme scrapbook 10C. This theme scrapbook also has a similar construction as the scrapbooks previously described, except for the graphics and coloring. The "travel" theme scrapbook has separate folders each with a quote from a famous writer.

Figure 10:
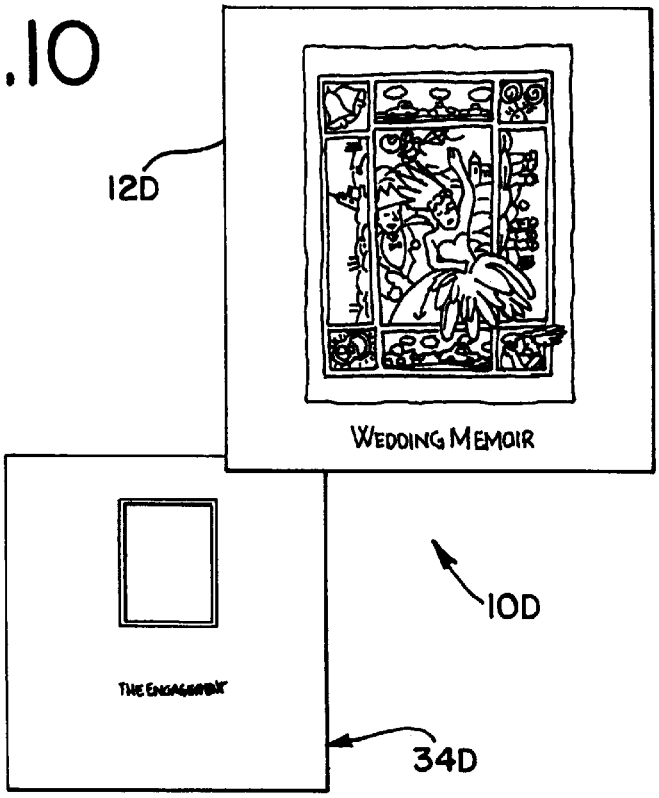
FIG. 10 shows a front view of a front cover and a front view of a folder of a "wedding" theme scrapbook.

FIG. 10 shows the front cover and a folder cover of a "wedding" theme scrapbook 10D. This theme scrapbook 10D has a similar construction as the scrapbooks previously described, except that the graphics and coloring may be different. The "wedding" theme scrapbook 10D may include separate folders for the "engagement," "the shower," "announcements," "the wedding day," "the wedding party," "the ceremony," "the reception," and "family and friends."

Figure 11:
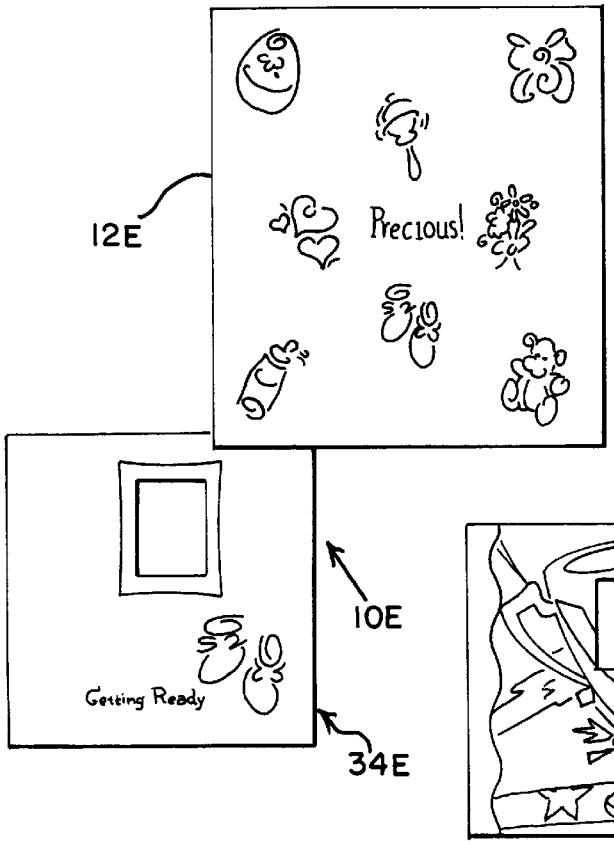
FIG. 11 shows a front view of a front cover and a front view of a folder of a "baby" theme scrapbook.

FIG. 11 shows the front cover and a folder cover of a "baby" theme scrapbook 10E. This theme scrapbook also has a similar construction as the other previously described scrapbooks. The "baby" theme scrapbook may have fewer or more folders than the others. The "baby" theme scrapbook 10E may include folders for "getting ready," "the shower," "the arrival day," "the homecoming," "the family," "the visitors," "first holidays," and "imemorable moments."

Figure 12:
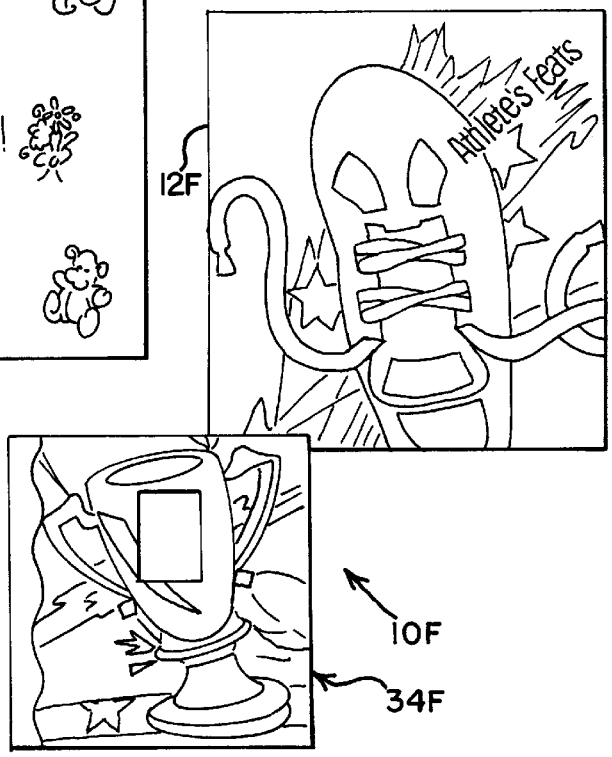
FIG. 12 shows a front view of a front cover and a front view of a folder of an "athletics" theme scrapbook.

FIG. 12 shows the front cover and a folder cover of an "athletics" theme scrapbook 10F. This theme scrapbook may include folders for "trophy," "megaphone," "pedestal," "blue ribbon," "pennant," "gold medal," "whistle," and "scoreboard."

Figure 13:
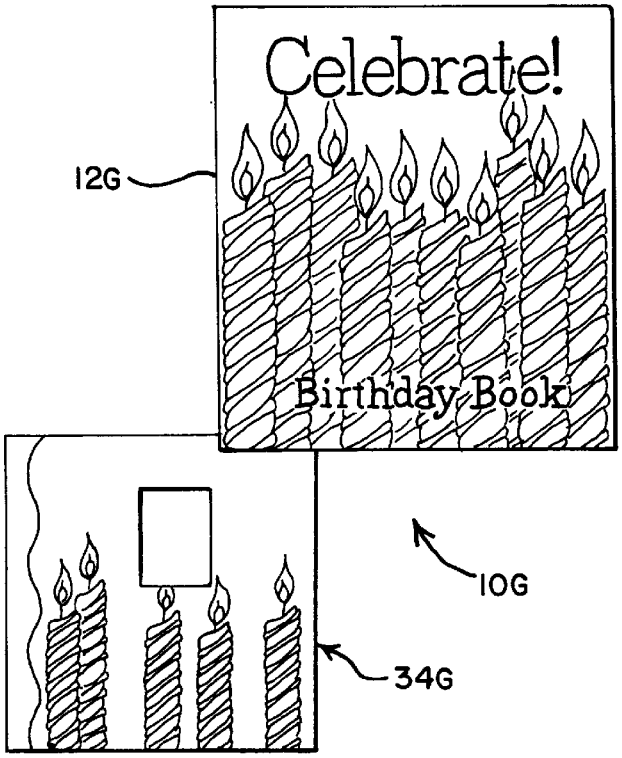
FIG. 13 shows a front view of a front cover and a front view of a folder of a "birthdays" theme scrapbook.

FIG. 13 shows the front cover and a folder cover of a "birthday" theme scrapbook 10G. This theme scrapbook include folders that display "candles" for birthdays from 1 to 10. Pictures and memorabilia from each birthday of a child from ages 1 through 10 are saved in separate folders.

These are just some of the examples of the kinds of themes that can be provided. Other kinds of themes may also be suitable.

It is intended that the foregoing detailed description be regarded as illustrative rather than limiting and that it is understood that the following claims including all equivalents are intended to define the scope of the invention.

I claim:

1. A scrapbook for storing memorabilia comprising:

a front cover;

a rear cover; and a plurality of folders attached between said front cover and said rear cover, wherein each of the plurality of folders comprises:

a folder cover formed by an inner portion and an outer portion, wherein said outer portion is connected to said inner portion at a centerfold that forms an outside edge of said folder cover such that said outer portion forms a flap that folds over said inner portion defining an interior of said folder, and wherein said inner portion is connected to the others of the plurality of folders and the front and rear covers at an inside edge thereof, wherein said inside edge of said inner potion is opposite from said centerfold;

a plurality of display sheets, wherein each display sheet is attached along an inside edge thereof to the others of said display sheets and to the folder cover of its respective folder; and a pocket located inside said folder cover and attached to said folder cover, said pocket open along a top edge thereof.

2. The invention of claim 1 wherein said folder cover has a display cutout opening located in said outer portion.

3. The invention of claim 1 wherein said front cover includes indicia indicating a theme associated with said scrapbook.

4. The invention of claim 3 wherein each of said plurality of folder covers includes indicia indicating a sub-category of said theme.

5. The invention of claim 3 wherein said theme relates to school years.

6. The invention of claim 4 wherein each sub-category indicates a separate grade of school.

7. The invention of claim 1 wherein said plurality of folders are removable from said scrapbook.

8. The invention of claim 1 wherein said plurality of display sheets are removable from said scrapbook.

9. The invention of claim 1 wherein said pocket is attached to said inner portion of said folder cover.

10. The invention of claim 1 wherein each of said plurality of folders is associated with a sub-category of a theme of said scrapbook.

11. The invention of claim 1 wherein said scrapbook includes indicia indicating a high school years theme.

12. The invention of claim 1 wherein said scrapbook includes indicia indicating a college years theme.

13. The invention of claim 1 wherein said scrapbook includes indicia indicating a travel theme.

14. The invention of claim 1 wherein said scrapbook includes indicia indicating a baby theme.

15. The invention of claim 1 wherein said scrapbook includes indicia indicating an athletics theme.

16. The invention of claim 1 wherein said scrapbook includes indicia indicating a wedding theme.

17. The invention of claim 1 wherein a legend area is located on an inside surface of the folder cover in each of said plurality of folders.

18. The invention of claim 1 wherein said scrapbook includes indicia indicating a birthday theme.

19. The invention of claim 18 wherein each of said plurality of folder covers includes indicia indicating a sub-category of said theme and wherein each sub-category indicates a separate birthday of a child.

* * * * *

UNITED STATES PATENT AND TRADEMARK OFFICE

CERTIFICATE OF CORRECTION

PATENT NO. : 5,947,522

DATED : September 7, 1999

INVENTOR(S) : Janis Boehm

It is certified that error appears in the above-identified patent and that said Letters Patent is hereby corrected as shown below:

In claim 1, line 16, change "potion" to --portion--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*